United States Patent [19]

Scholz et al.

[11] 4,355,782

[45] Oct. 26, 1982

[54] MOLD FOR FORMING FIREPLACES

[75] Inventors: Ray J. Scholz, Los Altos; William C. Southern, Los Gatos; Leslie R. Wieduwilt, Jr., Cupertino, all of Calif.

[73] Assignee: Sierra Precast, Inc., San Jose, Calif.

[21] Appl. No.: 228,149

[22] Filed: Jan. 26, 1981

[51] Int. Cl.[3] ..... B28B 7/22

[52] U.S. Cl. ..... 249/93; 16/105; 52/64; 249/161

[58] Field of Search ..... 249/91, 205, 114 R, 249/161-163, 166, 168, 169, 170, 219 R, 205, 129, 131, 83, 93, 118, 121, 122, 135, 139, 142, 144; 425/DIG. 44; 52/29, 64, 7, 72, 127, 173, 293, 276, 274, 749, 750; 248/293, 430, 670; 280/47.34; 16/18 R, 19, 105, 106, 107, 102, 97; 105/163 R; 104/106, 107, 109, 118, 246; 264/275

[56] References Cited

U.S. PATENT DOCUMENTS

| | | | |
|---|---|---|---|
| 170,790 | 4/1929 | Hall | 249/13 |
| 795,404 | 7/1905 | Miller et al. | 249/131 |
| 1,795,862 | 3/1931 | Johnson | 249/189 |
| 1,987,076 | 1/1935 | Pulis | 249/219 R |
| 3,168,771 | 2/1965 | Nelson | 249/161 |
| 3,301,249 | 1/1967 | Hendricks | 249/91 |
| 3,466,000 | 9/1969 | Southern et al. | 249/93 |
| 3,628,766 | 12/1971 | Hartmann | 249/131 |
| 3,744,184 | 7/1973 | Niemi et al. | 249/161 |
| 3,843,089 | 10/1974 | Scholz et al. | 249/161 |
| 3,844,524 | 10/1974 | Fisher et al. | 249/161 |

*Primary Examiner*—Willard E. Hoag

*Attorney, Agent, or Firm*—Jack M. Wiseman; Francis W. Anderson

[57] ABSTRACT

This invention concerns molds for forming concrete fireplaces and features mold sections mounted for rolling movement, and apparatus for suspending members in the mold during the casting operation.

8 Claims, 12 Drawing Figures

MOLD FOR FORMING FIREPLACES

BACKGROUND OF THE INVENTION

It has been recognized that in building a home or the like the use of a precast fireplace, instead of a fireplace which is built on the job brick-by-brick by a mason, has certain economic advantages and, accordingly, molds have been developed for casting such fireplaces. Typically the molds comprise a bottom section having the configuration of the rear wall, two opposed side sections for defining the side walls of the fireplace, and apparatus for suspending different members such as chimney tiles, and the firebox in the mold. To facilitate the separation of the mold side sections from the fireplace after it has been cast and has hardened, hinge connections have been provided between the side section and the bottom section so that the side sections can be pivoted downwardly away from the fireplace. Due to the length of the mold piano-type hinges have been used and such hinges have not been entirely satisfactory. The patents to Southern et al. U.S. Pat. No. 3,466,600 discloses hinged mold side sections as does the patent to Hendricks U.S. Pat. No. 3,301,249 which also discloses a toggle locking arrangement for the mold sections.

An object of the present invention is to provide an improved mold for casting fireplaces and in particular an improved arrangement for manipulating the mold sections and locking them in place.

SUMMARY OF THE INVENTION

The fireplace mold of the present invention includes a base section and two side sections mounted for translatory motion toward and away from sealing contact with the base section. An over-the-center mechanism is arranged to lock the molds in operative relation, and an arrangement for positioning the chimney tiles and the firebox-forming pattern in place includes means for suspening these members from the upper edges of the side mold sections while preventing these members from floating upwardly during the casting operation.

DESCRIPTION OF THE PREFERRED EMBODIMENT

Figures 1, 2, 3:
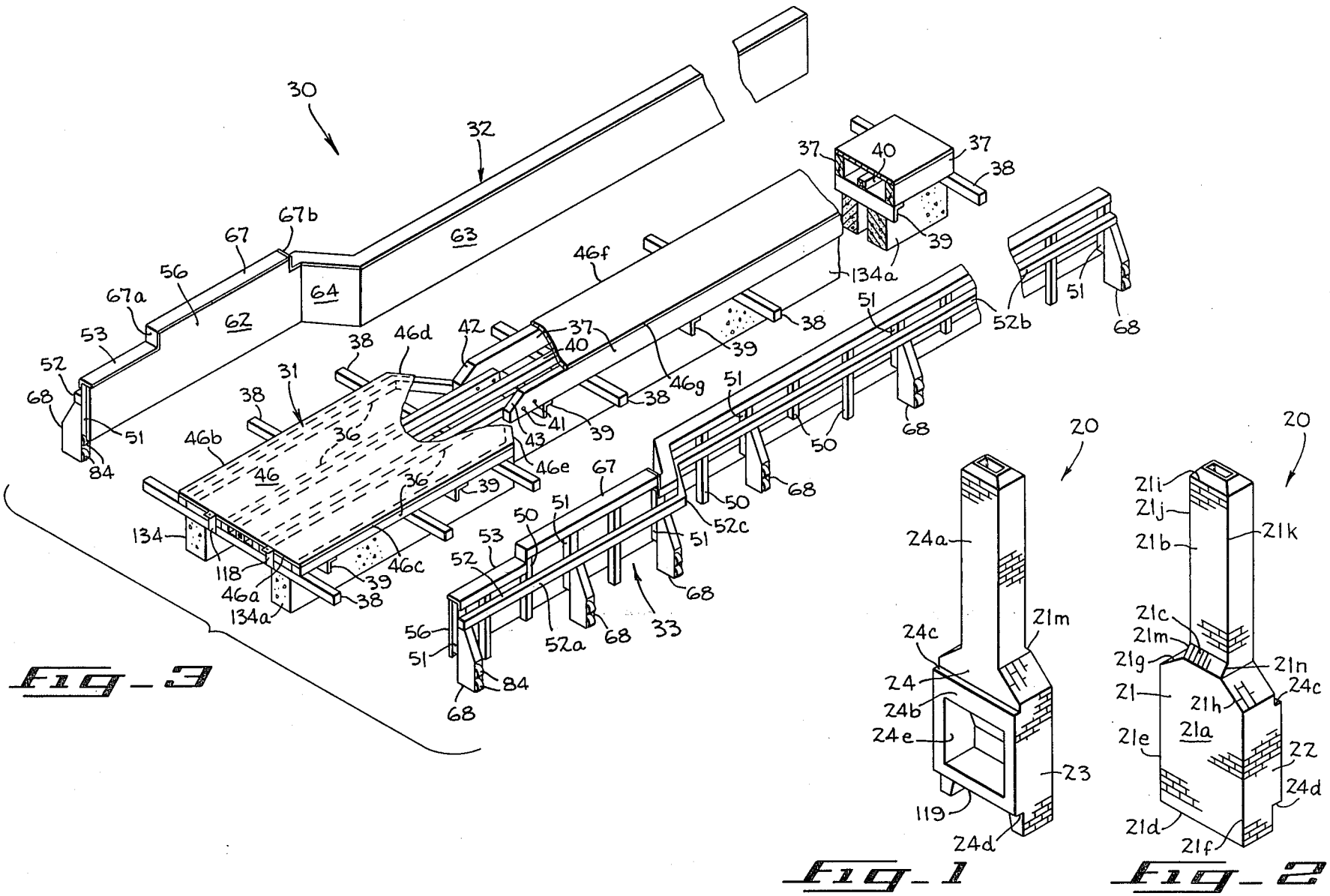
FIG. 1 is a diagrammatic perspective of a concrete fireplace of the type that is cast in the mold of the present invention.
FIG. 2 is a diagrammatic perspective, similar to FIG. 1 but showing the opposite side of the fireplace.
FIG. 3 is an exploded diagrammatic perspective of the major portions of three sections of the mold of present invention.

The mold of the present invention is adapted to be used to cast a concrete fireplace such as the fireplace 20 of FIGS. 1 and 2. This fireplace is provided with a rear wall 21 that has two spaced parallel surfaces **21*a* and 21*b* connected by an inclined surface 21*c*. The surface 21*a* has a lower edge 21*d*, parallel side edges 21*e* and 21*f*, and inclined edges 21*g* and 21*h*; the surface 21*b* has side edges 21*j* and 21*k* and a top edge 21*i*; and the surface 21*c* has side edges 21*m* and 21*n*. The side edges 21*m* and 21*j* are in alignment, as are the edges 21*k* and 21*n*, and all of these edges are in planes parallel to the planes of the side edges 21*e* and 21*f*. The fireplace has two side walls 22 and 23 which are mirror images of each other, and a front wall 24 that has two parallel planar surfaces 24*a* and 24*b*, the surface 24*b* being spaced from surface 24*a* by two outwardly projecting walls 24*c* and 24*d*. A firebox opening 24*e* is provided in surface 24*b***.

Figures 4, 4A, 5, 6:
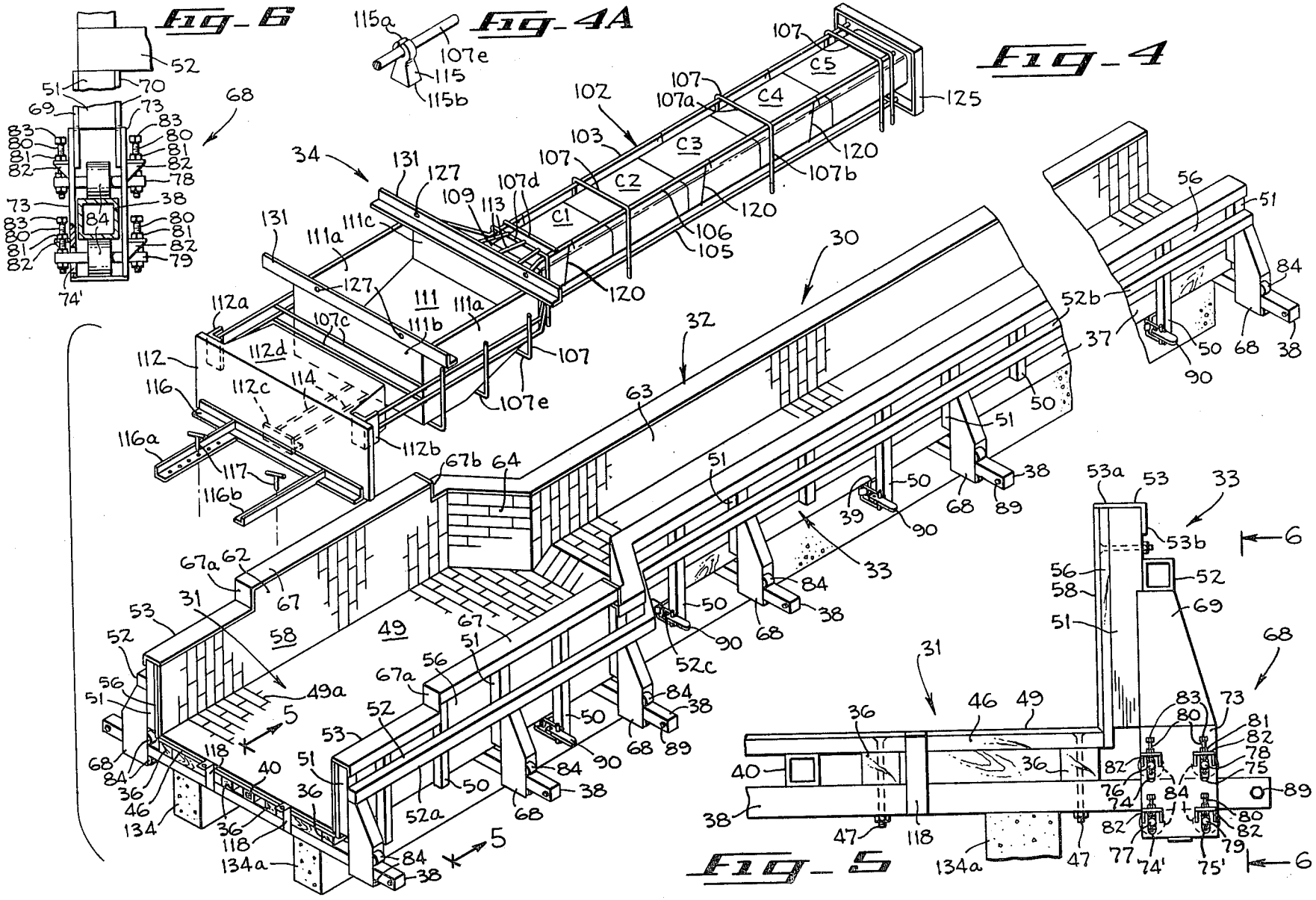
FIG. 4 is an exploded diagrammatic perspective of the four sections of the mold, particularly showing the base and side sections in closed position.
FIG. 4A is a diagrammatic perspective of one of the members used to support the reinforcing-bar cage of the mold.
FIG. 5 is a view taken along line 5—5 of FIG. 4.
FIG. 6 is an elevational view, partly broken away, taken looking in the direction of arrows 6—6 of FIG. 5.

In FIG. 4 the reference numeral 30 indicates generally a mold constructed according to the teachings of the present invention. This mold may be considered to have four main components, namely, a base section 31 which has a configuration corresponding to the configuration of the rear wall 21 of the fireplace, section 32 shaped to form one side wall, section 33 for forming the other side wall, and a multi-part apparatus 34 for suspending various parts, such as chimney tiles in the mold during the casting operation. In addition, a few other members, such as end plates, which will be described, are included in the complete mold.

Mold section 31 includes a frame structure made up of four relatively short longitudinally-extending wooden stringers 36 (FIG. 3) and two long wooden stringers 37 bolted to a plurality of transversely-extending square steel tubes 38 and angle bars 39, and a centrally-disposed square steel tube 40 that extends the full length of section 31 and is welded to the steel tubes 38 and bars 39. The long stringers 37 are also secured by bolts 41 to two of the short stringers 36 at a point where the two stringers 37 have downwardly inclined surfaces 42 and 43, respectively, which form a transition plane between the plane defined by the upper flat surfaces of the four short stringers 36 and the plane defined by the upper flat surfaces of the two long stringers. A layer of plywood 46 (FIG. 5) is secured over the stringers by means of the same bolts 47 that secure the stringers to the cross members of the frame to form a composite surface which includes: a first planar surface bounded in part by a lower straight edge **46*a* (FIG. 3), two side edges 46*b* and 46*c* at right angles to edge 46*a*, and two inwardly-extending shoulders 46*d* and 46*e*; a second planar surface inclined upwardly from the first surface and a third planar surface parallel to but spaced from the first surface and having side edges 46*f* and 46*g*. The side edges 46*f* and 46*g* are parallel to each other and to the edges 46*b* and 46*c*. It will be apparent from FIG. 2 that this composite surface has a configuration corresponding substantially to the configuration of the rear wall 21 of the fireplace of FIGS. 1 and 2**.

A liner 49 (FIGS. 4 and 5) of flexible material is positioned over the plywood layer 46 and bonded thereto by means of an adhesive. The liner, which is about ½ inch thick and is made from a liquid urethane prepolymer that is marketed under the name CONOTHANE by Conap, Inc. of Olean, N.Y., is prepared in a mold which forms a flat surface on one side of the liner and a series of raised edges 49*a* (FIG. 4) on the other. The pattern on the liner coincides with the pattern presented by an elevational view of a flat wall of hand-laid bricks. After being prepared at a remote location, the liner is applied in sheet-form to the plywood layer 46, when the section 31 is in a generally horizontal position, and trimmed so that the edges of the liner coincide with the edges of the plywood layer to which it is secured.

The mold section 33 (FIG. 4) includes a rigid metal frame made up of a plurality of spaced, parallel, upright steel channels 50 and box-beams 51 which are welded to one face of a generally longitudinally-extending steel tube 52. The tube 52, which is square in cross-section and is disposed at right angles to the channels and beams, has two parallel sections 52*a* and 52*b* connected by an inclined section 52*c*. A steel angle bar 53, (FIG. 5) which is parallel to tube 52 along its entire length, has one leg 53*a* welded to the upper ends of the channels and beams and the other leg 53*b* extending down alongside the outer side of these members. The leg 53*a* extends inwardly a short distance past the inner edges of the channels and box-beams, and a layer 56 of plywood is bolted to the face of the channels and beams. A liner 58, which is identical to liner 49 of mold section 31 except for its peripheral configuration, is secured to the inner surface of the plywood layer 56. The upper edges of the liner 58 and of the plywood layer 56 abut the overhanging inner edge of leg 53*a* of the angle bar 53 so that the bar protects these members from damage by accidental impacts and the like.

It will be particularly noted in FIG. 3 that the inner face of mold section 32, which is identical to section 33 and is a mirror image of section 33, is not disposed in a single plane but is formed to provide a first planar surface 62, a second planar surface 63 parallel to surface 62, and an inclined planar surface 64 which provides a transition surface between the two surfaces 62 and 63. It will be understood that the same frame construction described above is used in both mold side sections 32 and 33, and that the portions of the longitudinally-extending tube 52 and the angle bar 53 in the inclined portions of these sections are blended into and welded to the corresponding members in the parallel frame sections so that each side section is a rigid unitary structure. Also, the edges of the liner sections may be trimmed to form beveled edges, as seen in FIG. 5, to aid in obtaining a sealing engagement of the side mold sections with the base section.

At a location between one end of the mold and the inwardly inclined section, certain of the box-beams 51 and channels 50 of the side sections are made of longer length than the corresponding members in the rest of the mold so that the section of the angle bar 53 that is welded on the ends of these longer members is in a plane spaced above the plane of the other parts section of the angle bar 53. Accordingly, each side section 32 and 33 has a rectangular portion 67 (FIG. 3) projecting away from the rest of the mold section and providing two spaced vertical end surfaces 67*a* and 67*b*. Since these side mold sections are disposed in a generally vertical position during the fireplace-casting operation, the portion 67 may be said to extend upwardly from the main portion of the mold section.

A roller assembly 68 (FIGS. 4, 5 and 6) is mounted on each box-beam 51. This unit includes two parallel plates 69 and 70, each of which is welded to the under-side of the longitudinal tube 52 and to one face of the box-beam. A mounting plate 73 is welded to and forms a downward extension of each plate 69 and 70, and each mounting plate has a pair of aligned slots 74 and 74′ (FIG. 5) that are parallel to an adjacent pair of aligned slots 75 and 75′. The two slots 74 and 74′ in one mounting plate 73 are directly opposite the slots 74 and 74′, respectively, in the opposed mounting plate. Similarly, the slots 75, 75′ in one mounting plate are opposite the slots 75, 75′, respectively, in the other plate. Shafts 76 and 77 (FIG. 5) extend through the aligned slots of each opposed pair 74—74 and 74′—74′, respectively, and shafts 78 and 79 extend through the aligned slots of each opposed pair 75—75 and 75′—75′, respectively. Each of the four shafts 76–79 is provided with a tapped opening near each end. A screw 80 is threaded through the tapped opening at each end of each shaft and through a nut 81, which is secured to the upper surface of a bracket 82 welded to the outer face of each plate, there being one bracket directly above each of the eight slots. Each screw has a hexagon head 83 on its upper end to facilitate rotation of the screw by use of a wrench. A roller 84, which is provided with a central bearing that has an inner race is pressed on each shaft 76 and 77. When the mold is assembled, each end of each of the steel tubes 38 of the mold section 31 extends through the space between the spaced rollers 84 of a roller assembly so that the lower roller bears against the underside of the tube 38 and the upper roller bears against the top side. It will be evident that by rotating the screws 80 the position of the tube confined by the four rollers can be changed.

The projection of a tube 38 through each set of rollers is assured by spacing the tubes 38 of mold section 31 at the same distance apart as the box-beams 51 of sections 32 and 33, and by locating the associated tubes 38 and the box-beams at the same distance away from the bottom end of the mold sections. A stop bolt 89 (FIG. 5) extending across the outer ends of each tube 38 is adapted to be engaged by the mounting plates 73 to limit the movement of the side sections 32 and 33 relative to the base section 31.

As mentioned above, mold section 32 is identical to mold section 33 only the parts are oppositely disposed as illustrated in FIG. 3.

Figure 7:
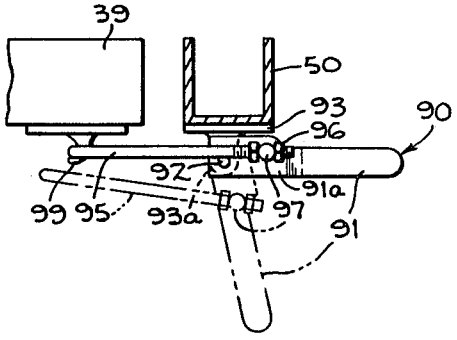
FIG. 7 is a section taken along line 7—7 of FIG. 10.
Figure 8:
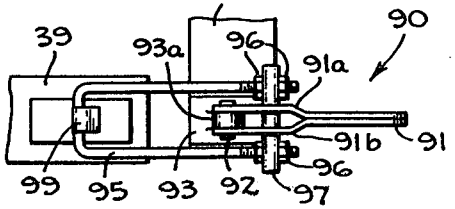
FIG. 8 is an elevational view of the apparatus of FIG. 7.

As seen in FIG. 4, at spaced intervals along the side of mold section 33, a lock 90 is mounted on a downward extension formed on the lower end of several of the channels 50. These locks, which are also mounted in an identical manner at corresponding points on mold section 32, hold the mold closed after the side sections 32 and 33 are rolled into contact with the base section 31. Each lock comprises a lever 91 (FIG. 7 and 8) having spaced arms 91*a* and 91*b* pivotally mounted on a pin 92 carried by an arm 93*a* projecting outwardly from which is secured to the face of the associated channel 50. A rigid U-shaped loop 95 is provided with two threaded ends, each of which is adjustably secured by nuts 96 on a pin 97 which is pivotally disposed in aligned openings in the arms 91*a* and 91*b* of the lever 91. At its closed end, the loop 95 is adapted to be disposed over a flat elongated hook 99 carried by one of the angle bars 39 of the mold section 31. It will be understood that the positions of the angle bars 39 on mold section 31 and the positions of the elongated channels 50 that carry the locks 90 are so chosen that there is an angle bar in alignment with each of these channels. Accordingly, there is a hook 99 adjacent each lock 90. When the loop is positioned over the hook and the lever 91 is pivoted counterclockwise (FIG. 7) the mold sections will be drawn into tight sealing engagement. In the locked position, the lever abuts the plate 93, and the pin 97 that carries the loop is disposed in an overcenter position relative to pin 92.

The apparatus 34 for suspending various parts in the molds includes a cage 102 (FIGS. 4 and 9) of concrete-reinforcing steel bars which includes four longitudinally-extending bars 103–106 (FIG. 10) and a plurality of transversely-extending inverted U-shaped bars 107 that have generally horizontally oriented bases 107*a* and depending arms 107*b* welded to the bars 103–106 to form a relatively rigid cage. At the transition area between the firebox and the chimney, the bars 103–106 are bent at an angle laterally to pass alongside the sloping side walls of a damper unit 109. The bars are then bent again to provide portions that extend generally longitudinally of the mold between the side mold sections 32 and 33 and the outer walls of a box-like form 111 which defines the firebox opening. At their ends, the pairs of rods 103, 104 and rods 105, 106 are welded to brackets 112*a* and 112*b*, respectively, (FIG. 4) which abut a closure plate 112 that extends across the lower end and closes the mold. The plate 112 fits snugly between the side and base mold sections and its movement away from the form 111 is prevented by a bar 116 that bears against plate 112. The bar 116 has two perforated angular extension members 116*a* and 116*b*, and pins 117 are adapted to be inserted through holes in the members 116*a* and 116*b* and through aligned holes in an upper flange of a plate 118 (FIG. 9) secured to mold section 31 to lock the bar 116 and the closure plate 113 in selected position. A box-like extension 112*d* is provided on one face of closure plate 112 and this member extends into the mold to cause a large cavity 119 (FIG. 1) to be formed in the lower end of the fireplace.

Transverse bars 107*c*, (FIG. 4) which are welded between the bars 103, 106 and 104, 105 near their ends, extend across the space below the form 111. Also, at the transition section between the chimney and the firebox form 111, a grid 113 of reinforcing bars is secured to transverse bars 107*d* and extend forward to a position close to an inclined wall of the damper assembly 109. In the area of the form 111, the U-shaped bars 107 are upright so that their base sections 107*e* underlie the form 111. A pair of bars 114 are supported from the base sections and are positioned between the fire-box form and the base mold section 31. At their ends these bars 114 are welded to a bracket 112*c* which abuts the plate 112.

The base sections 107*e* of the bars 107 beneath the form 111 are held in spaced relation to the base mold section 31 by spacers which may take several forms such as small blocks of wood or relatively small plastic pedestals 115 (one only being shown in FIG. 4A) which have U-shaped upwardly-opening ends 115*a* which receive the bar sections 107*e* and have flat bases 115*b* that rest on the mold section 31. The reinforcing-bar cage is held in the desired position in the mold by the engagement of the brackets 112*a*, 112*b* and 112*c* with plate 112 and by plastic caps 108 (FIG. 10) which are positioned on the lower ends of the arms 107*a* that extend downwardly toward the mold section 31. Before concrete is poured in the mold, the caps rest on the mold section 31. After the concrete has been poured into the mold and it is vibrated, the caps rise slightly and permit a layer of concrete to form beneath the caps. Pedestals, such as pedestal 115 (FIG. 4A) could be used to support this section of the cage. Such pedestals would receive the longitudinal bars 104 and 105.

Figure 9:
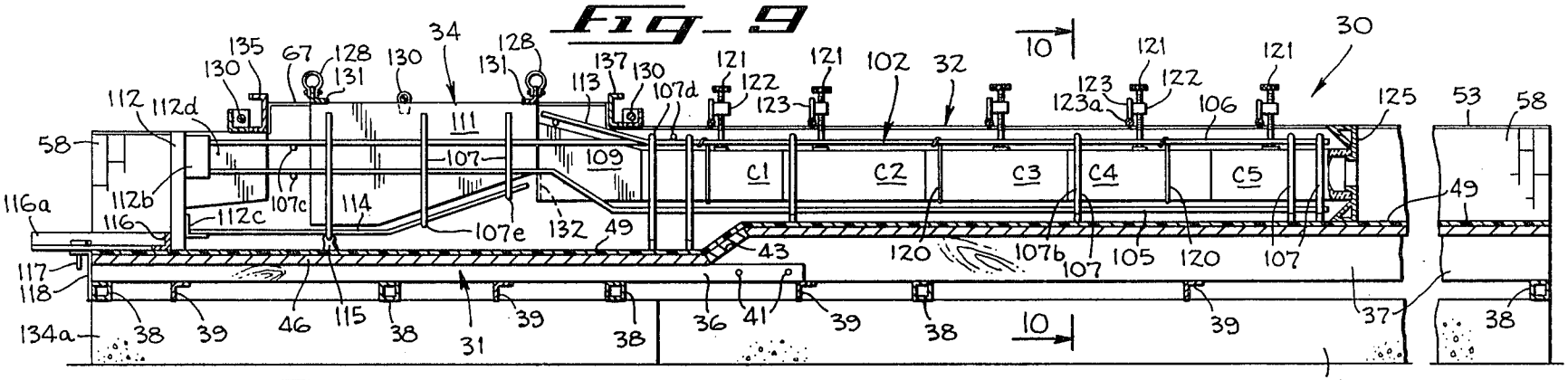
FIG. 9 is a diagrammatic longitudinal section of the assembled mold.
Figure 10:
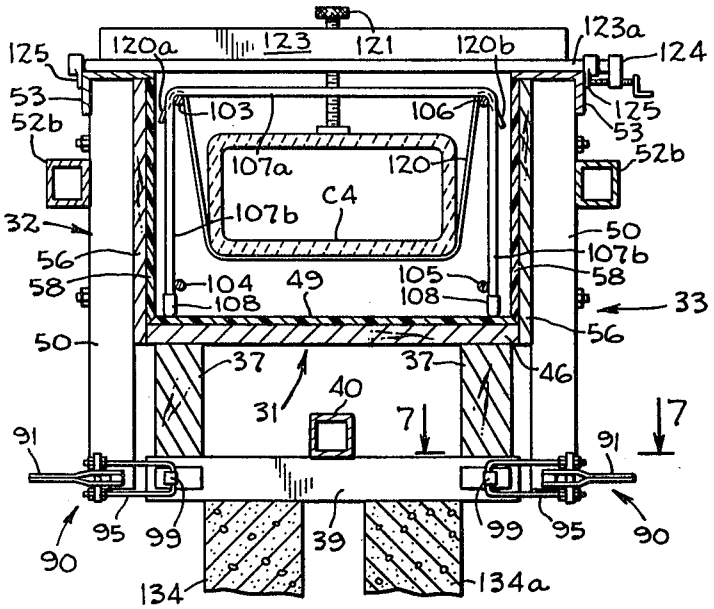
FIG. 10 is a section taken along line 10—10 of FIG. 9.

A plurality of chimney tiles C1–C5 are supported in end-to-end relation in the mold by a plurality of support rods 120. As seen in FIG. 10, each rod 120 has ends 120*a* and 120*b* hooked over one of the longitudinal rods 103 and 106, and a central portion that underlies the chimney tile. To prevent the chimney tiles from floating upwardly while the concrete is being poured, hold-down screws 121 which are threaded through tapped sleeves 122 (FIG. 9) carried by transverse support bars 123, bear down on the upper surface of each tile. Each support bar has a cylindrical rod 123*a* (FIG. 10) extending across its lower end and extending outwardly past each side mold section. A clamp 124 which has pads 125 at each end of each rod locks the bar to the adjacent side mold and prevents outward movement of the side mold sections.

The uppermost chimney tile C5 bears against a plate 125 that closed the upper end of the mold. The lower rectangular opening in the lowest tile C1 receives therein a rectangular flange (not shown) projecting upwardly from the upper periphery of the damper assembly 109 so that, after the chimney tiles are locked in plate, the damper assembly can be temporarily supported by the engagement of the flange inside the end of tile C1, while the firebox form 111 is being lowered into place.

Figure 11:
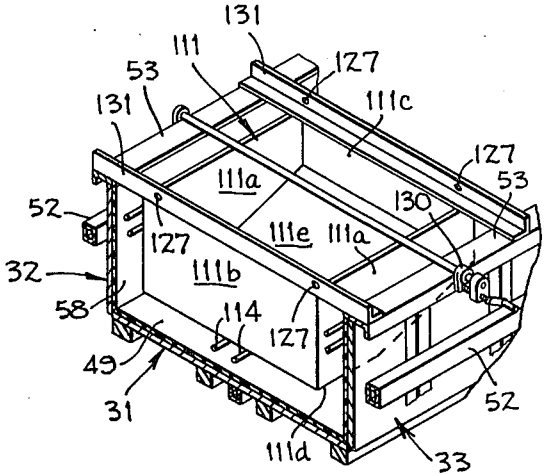
FIG. 11 is a diagrammatic perspective of a portion of the mold of FIG. 9 particularly showing the form for the fire-box opening.

The firebox form 111 (FIG. 11) is an open-top box-like member made of welded steel plate and comprises two spaced side walls 111*a*, a lower end wall 111*b*, an upper end wall 111*c*, parallel to wall 111*b*, a flat bottom wall 111*d* and an inclined bottom wall 111*e*. A relatively narrow ledge extends around the open upper end of the form and two angle bars 131 welded across these ledges, one parallel to end wall 111*b* and one parallel to end wall 111*c*. These angle bars extend past the sides of the form 111 and are adapted to rest on the top surface of the angle bars 53 that extend along the mold sections 32 and 33 at the upwardly extending areas 67, and thereby position the upper edges of the form 111 at the same level as the upper edges of these mold sections, as seen in FIG. 9. The angle bars are provided with holes 127 which receive U-shaped removable metal connectors 128 (FIG. 9) by which a crane can lift and lower the firebox from relative to the rest of the mold. The upper end of form 111 is closed, as seen in FIG. 11, and, in the installed position of FIG. 9, this upper end bears against the open lower end of the damper box, the lower portion of this end of the damper box being closed by a transverse plate 132.

One or more clamps 130, (FIG. 11) that are similar to the clamps 124 of the hold-down mechanisms may be mounted across the upper edges of the mold sections 32 and 33 to straddle the mold and further prevent outward movement of the side mold sections.

The mold is assembled by laying the base section 31 on a flat concrete surface such as that provided by the coplanar horizontal upper surfaces of two generally parallel concrete foundation members 134 and 134*a*. The side sections 32 and 33 are then placed on opposite sides of the base section and each of the several roller assemblies 68 is moved into supported position on one of the tubes 38 of the base.

Prior to a fireplace being cast in the mold, the mold is in open condition with the side sections 32 and 33 located laterally outwardly from the base section 31. In this position, the roller assemblies of the side sections abut stop bolts 89. The mold is closed by rolling each side section inwardly until the lower edges of the side sections abut the side edges of the base section and then the loops 95 of the locks 90 are engaged over the hooks 99 on the base section. When the lock levers are moved to overcenter position, the three mold sections are held together in sealing engagement.

The closure plate 125 is then positioned across the upper end of the mold and the reinforcing bar cage 102 is lowered into the mold with the plastic feet 108 resting on the base section 31. The support brackets 120 are hooked over the upper bars of the cage and the chimney tiles are put into place starting with tile C5. The damper unit 109 is then positioned in the mold by inserting the flange at its upper end in the lower end of the tile C1. The fire-box opening form 111 is then lowered into place with its upper end registering with the upper portion of the lower end of the damper unit. The bottom closure plate 112 is then locked into position. The chimney tiles hold down screws 121 are positioned over the tiles and the associated clamps 124 are actuated to engage the ledge 53 of the side sections. Additional clamps, such as clamp 130 (FIG. 11) may be connected across the top of the mold. A transverse plate 135 (FIG. 9), is pressed and clamped against the two vertical surfaces 67*a* of the side mold sections by one of the clamps 130. A plate 137 is pressed and clamped against the two vertical surfaces 67*b* of the side sections by another clamp 130. The mold is then ready to receive the concrete mixture.

When the concrete has set-up, the clamps 124 associated with the hold-down screws 121 are released, as also are the clamps 130 which straddle the form 111 and hold the plates 135 and 137 in place. The hold-down screws 121, the plates 135 and 137, and the various clamps are removed from the mold. The top and bottom closure plates 125 and 112 respectively are then removed, and the mold side sections 32 and 31 are rolled away from the fireplace. The fire-box form 111 is then lifted out of the fireplace.

What we claim as new and wish to protect by Letters Patent is:

1. In a mold, a first mold section having a concrete-engaging surface bounded by two spaced side edges, second and third sections, and means mounting said second and third sections on opposite sides of said first section for translatory movement into sealing contact with said side edges of said first section, said mounting means including a plurality of roller assemblies carried by each of said second and third sections, each assembly including a pair of plates mounted in spaced parallel relation on the associated mold section, each plate having a pair of aligned slots, each slot in one plate being in alignment transversely of the plates with a slot in the other plate, a pair of shafts, each shaft extending through a pair of transversely aligned slots, each shaft having a threaded hold adjacent each end, an internally-threaded member carried by each plate adjacent each slot, a screw threaded through one of said internally-threaded members and through a threaded hole in an adjacent shaft, and a roller disposed on each shaft.

2. In a mold, a first mold section having a concrete-engaging surface bounded by two spaced side edges, second and third mold sections, and means mounting said second and third sections on opposite sides of said first section for translatory movement into sealing contact with said side edges of said first section, said mounting means including a plurality of roller assemblies mounted on each of said second and third sections, and a plurality of rods mounted transversely on said first section, each rod being arranged to coact with one of said roller assemblies to mount an associated second or third section for movement relative to said first section.

3. In a mold, a base section having a configuration conforming generally to the configuration of the back wall of a fireplace, a first side section having a configuration corresponding generally to the side elevation of one side face of a fireplace, a second side section having a configuration corresponding generally to the side elevation of the other side face of the fireplace, a plurality of rods secured to and extending transversely of said base section, and roller means mounting said side sections for movement into engagement with said base section including a plurality of roller assemblies carried by each side section, each assembly including a plurality of rollers movable along a laterally projecting end of one of said rods with at least one roller engageable with one face of said one rod and a plurality of rollers engageable with the opposite face of the rod at spaced points to prevent tilting of the side section relative to said base section.

4. In a mold, a first section having a surface conforming to the configuration of a back wall of a fireplace, a second section having a surface conforming to the configuration of one side wall of the fireplace, a third section having a surface conforming to the configuration of the other side wall of the fireplace, transverse rods secured to and projecting from opposite sides of said first section, and means for mounting said second and third sections at opposite sides of said first section at substantially right angles thereto and with a lower marginal area of each sidewall adjacent to one of the side edges of said first section, said mounting means further including roller means connected to said second and third sections for moving said sections toward said first section to bring the marginal edges of said sections into contact with the side edges of said first section, each assembly comprising spaced rollers in engagement with opposite faces of a projecting end of one of said rods.

5. A mold according to claim 4 wherein said first mold section includes a relatively narrow chimney-defining planar portion, a wide planar portion in a plane parallel to but spaced from the plane of said chimney-defining portion, an inclined planar portion connecting said wide and narrow portions, said wide portion having inclined edges connecting the opposite side edges of said planar portion at its widest part with the side edges of said inclined planar portion; said second and third mold sections being disposed in confronting relation on opposite sides of said first section; each of said second and third sections having a first planar surface arranged to engage one of the edges of the wide portion of said wide planar portion, an inclined planar surface arranged to engage one of the inclined edges of said wide planar portion, and a second planar surface arranged to engage an edge of said chimney-defining portion when the second and third mold sections are moved into sealing contact with said first section.

6. A mold for a fireplace comprising a first section having a surface conforming to the configuration of a back wall of a fireplace, a second section having a surface conforming to the configuration of one side wall of the fireplace, a third section having a surface conforming to the configuration of the other side wall of the fireplace, means for mounting said second and third sections at opposite sides of said first section at substantially right angles thereto and with a lower marginal area of each side wall adjacent to one of the side edges of said first section, said mounting means further including a plurality of transverse rods secured to and projecting laterally from each side of said first section, roller means connected to said second and third sections for moving said sections toward said first section to bring the marginal edges of said sections into contact with the side edges of said first section (,) and including a plurality of roller assemblies carried by each of said second and third sections, each assembly including spaced rollers engageable with opposite faces of a projecting end of one of said rods, means positionable across each end of said first section and between said side sections when said side sections abut said first section to form an open top cavity, and means for positioning chimney tiles, a damper box, and a fireplace form in said cavity.

7. The mold of claim 6 wherein said positioning means includes a concrete reinforcing cage of bar members extending longitudinally and transversely of said first and second mold sections.

8. The mold of claim 7 additionally including pedestal members supporting selected reinforcing bars in spaced relation to adjacent mold sections.

* * * * *